US006971437B1

(12) United States Patent
Cossey

(10) Patent No.: US 6,971,437 B1
(45) Date of Patent: Dec. 6, 2005

(54) LOST FOAM CASTING PATTERN

(75) Inventor: Neil R. Cossey, Franklin, TN (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/996,185

(22) Filed: Nov. 23, 2004

(51) Int. Cl.[7] ..... B22C 7/02
(52) U.S. Cl. ..... 164/235; 164/34; 164/244
(58) Field of Search ..... 164/235, 244, 164/34, 35

(56) References Cited

U.S. PATENT DOCUMENTS 3,835,913 A * 9/1974 Vandemark et al. ..... 164/35
4,300,617 A * 11/1981 Bauer ..... 164/244
6,880,618 B2 * 4/2005 Goettsch et al. ..... 164/516

* cited by examiner

*Primary Examiner*—Len Tran
(74) *Attorney, Agent, or Firm*—Charles H. Ellerbrock

(57) ABSTRACT

Pattern for the lost foam casting process including a pouring-basin-foming portion, a sprue-forming portion, a runner-forming portion, a gate-forming portion, and a riser-forming portion. The sprue-forming portion forms an inverted conical sprue having a blade-lightener therein for quickly filling, and substantially simultaneously firing, the gates. A glue joint may be used between the pouring- basin-forming portion and the sprue-forming portion to increase the residence time of the melt in the pouring basin. The runners formed by the pattern each have an inline riser through which melt flows during pouring and in which melt is stored to feed the casting with melt during shrinkage of the casting A sand dam surrounds the mouth of each gate and traps particulates from a liquid styrene layer that precedes the melt front in the riser.

8 Claims, 6 Drawing Sheets

LOST FOAM CASTING PATTERN

TECHNICAL FIELD

This invention relates to the "Lost-Foam" process for casting metals, and more particularly to a fugitive foam pattern for such process.

BACKGROUND OF THE INVENTION

The so-called "lost-foam" casting process is a well-known technique for producing metal castings wherein a fugitive, pyrolizable, polymeric, foam pattern (including casting, gating, runners and sprue) is covered with a thin (i.e. 0.25–0.5 mm), gas-permeable, refractory (e.g. mica, silica, alumina, alumina-silicate, etc.) coating/skin, and embedded in compacted, unbonded sand to form a pattern-filled, mold cavity within the sand. Molten metal (hereafter "melt") is then introduced into the pattern-filled mold cavity to melt, pyrolyze, and displace the pattern with melt. Gaseous and liquid decomposition/pyrolysis products escape through the gas-permeable, refractory skin into the interstices between the unbonded sand particles. The casting rate (i.e. the rate at which the metal enters the mold cavity) is limited by the rate the advancing melt front can displace the pattern from the cavity, which, in turn, is affected by the thickness and permeability of the refractory skin/coating. Typical fugitive polymeric foam patterns comprise expanded polystyrene foam (EPS) for aluminum castings, and copolymers of polymethylmethacrylate (PMMA) and EPS for iron and steel castings.

The polymeric foam pattern is made by injecting pre-expanded polymer beads into a pattern mold to impart the desired shape to the pattern. For example, raw expandable polystyrene (EPS) beads (Ca. 0.2 to 0.5 mm in diameter), containing a blowing/expanding agent (e.g. n-pentane), are: (1) first, pre-expanded at a temperature above the softening temperature of polystyrene and the boiling point of the blowing agent; and (2) then, molded into the desired configuration in a steam-heated pattern mold which further expands the beads to fill the pattern mold. Complex patterns and pattern assemblies are made by molding several individual mold segments, and then gluing them together to form the finished pattern/assembly.

The melt may be either gravity-cast (i.e. poured from an overhead ladle or furnace), or countergravity-cast (i.e. forced upwardly by vacuum or low pressure into the mold cavity from an underlying vessel, e.g. a furnace). In gravity-cast lost-foam processes, the metallostatic head of the melt in the sprue and pouring basin is the driving force for filling the mold cavity with melt. Gravity-cast, lost-foam processes are known that: (1) top-fill the mold cavity by pouring the melt into a basin overlying the pattern so that the melt flows downwardly into the mold cavity through a gating system (i.e. one or more gates) located above the pattern; (2) bottom-fill the mold cavity by pouring the melt into a vertical sprue that lies adjacent the pattern and extends from above the mold cavity to the bottom of the mold cavity for filling the mold cavity from beneath through a gating system located beneath the pattern so that the melt flows vertically upwardly into the mold; and (3) side-fill the mold cavity by pouring the melt into a pattern that forms a vertical sprue that lies adjacent the mold cavity, and communicates with the mold cavity via a plurality of vertically aligned runners and gates that horizontally fill the mold cavity from the side thereof. The vertical sprue may be flanked by two or more mold cavities for making multiple castings with a single pour.

Faster casting rates result in less heat loss from the melt. Less heat loss during pouring keeps the melt hotter, which, in turn, reduces the formation of "folds"(i.e. pyrolysis products trapped at the confluence of cold metal fronts), and "cold-shuts" (i.e. sites where metal that does not completely fill the pattern due to premature solidification) in the casting.

Casting rates have heretofore been increased by providing one or more melt flow-channels (i.e. foam-free shafts) that extend into the pattern, and through which the melt can rush into selected portions of the pattern. Such flow channels are often called "lighteners" (which term shall be used herein), and are typically formed in the pattern at the joints where individual pattern segments are glued together to form a complete pattern. Alternatively, for straight lighteners, the pattern may be molded around an insert (e.g. a rod) that is subsequently withdrawn from the pattern leaving the lightener. Lighteners can classified both as to their "type" (i.e. their configuration), and as to their "application" (i.e. their location in the pattern). For example, one "type"-classified lightener is a so-called "pencil"-lightener which is a long, slender, cylindrical or polygonal, foam-free shaft formed in the pattern. One "application"-classified lightener, for example, is a so-called "sprue"-lightener which is a lightener used in a sprue-forming portion of the foam pattern. See also "runner"-lighteners, for lighteners used in runner-forming portions of a pattern.

The side-fill lost foam process has heretofore been used commercially to manufacture cylinder heads for internal combustion engines. Patterns therefor have heretofore had a central, vertical, rectangular (ca. 4.3 cm.×4.1 cm.), sprue-forming portion (i.e. for forming a sprue in the compacted sand) flanked by a pair casting-forming mold cavities (i.e. for forming/shaping the heads), each coupled to the central sprue-forming portion by fourteen vertically arranged, runner-forming and gate-forming portions (i.e. for forming runners and gates respectively). Pencil-type lighteners extend the length of the sprue-forming portion (i.e. a sprue-lightener), and into the top four of the fourteen runner-forming portions (i.e. runner-lighteners). A pouring-basin-forming portion of the pattern forms a pouring basin that overlies the sprue-forming portion, and receives melt from a ladle, furnace etc. for gravity delivery to the sprue formed by the sprue-forming portion. A fugitive plug, made from the same foam as is used to make the pattern, is positioned between the pouring basin and the upper end of the sprue, and serves to delay outflow of melt from the basin into the sprue sufficient to provide enough residence time (i.e. 1–2 secs) for a prescribed amount of melt to accumulate in the pouring basin. The prescribed amount is sufficient to allow the melt therein to become quiescent, degas, and build-up a metallostatic head sufficient to cause the melt to gush forcefully out of the basin, and into the sprue, when the plug releases (i.e. evaporates), so as to quickly (ca. 1 sec) fill the sprue-lightener and force any air or pyrolysis gases that might otherwise be trapped in the sprue-lightener into the surrounding sand without creating any bubbles in the melt.

SUMMARY OF THE INVENTION

The present invention improves the aforesaid commercial process by: (1) rapidly filling the sprue with less turbulence than heretofore; (2) reducing the heat lost from the sprue, and consequently filling the mold cavity with hotter melt that reduces the formation of folds and cold-shuts; (3)

removing particulates (e.g. sand) from the liquefied foam layer that precedes a melt flow-front approaching a gate; (4) providing multiple risers at the several gates for degassing the melt, and supplying it to the mold cavity during pouring and as the casting shrinks; (5) fine tuning the residence time for the melt in the pouring basin; and (6) substantially simultaneously "firing" the gates such that they all begin supplying metal to the mold cavity within 1 second of each other.

The present invention relates to fugitive, polymeric foam patterns used in the lost foam process for casting of a metal melt. Such patterns comprise a plurality of discrete portions which, when embedded in the unbonded sand, form: (1) a pouring basin that receives melt from an external supply thereof and dispenses it through an outlet from the basin; (2) a vertical sprue that underlies the basin and has a sprue-lightener extending the length thereof for rapidly advancing melt into the longitudinal center of the sprue; (3) at least one mold-cavity laterally adjacent the sprue, for forming a casting; (4) a plurality of runners vertically arranged along and between the sprue and the mold cavity for delivering melt to the mold cavity; and (5) a plurality of gates each communicating a runner with the mold cavity for admitting melt into the cavity. The present invention is an improvement on such patterns wherein: (a) the sprue-forming portion of the pattern comprises an inverted cone having a wall that tapers from an upper end adjacent the basin to a lower end that defines a first included angle between about 4° and about 8° to minimize turbulence of the melt at the lower and upper ends, respectively, during pouring of the melt, and to reduce heat losses from the melt in the sprue; (b) the sprue-lightener comprises a tapering blade-lightener configured to substantially simultaneously initiate flow of the melt through the gates into the mold cavity, which blade-lightener has a pair of opposing edges that lie inboard the wall and define a pair of opposing faces that [1] are each significantly wider than the blade-lightener is thick, and that [2] fill the majority of the vertical cross section of the sprue-forming portion (i.e. in a plane through the face); and (c) a plurality of runner-lighteners each extending into one of the runners from an edge of the blade-lightener for rapidly advancing melt into the runners from the sprue-lightener. Preferably, a fugitive plug is provided between the basin and the sprue for delaying the outflow of melt from the basin into the sprue until a prescribed amount of melt has accumulated in the basin. Most preferably, the edges of the blade-lightener converge near the bottom of the sprue to define a second included angle equal to about the first included angle for substantially non-turbulent filling of the sprue-lightener.

Further improvement is achieved by providing each runner with an inline chamber that defines a riser through which melt flows to supply the gate during pouring of the melt, and in which melt is stored for outflow into the mold cavity to feed shrinkage in the casting after the melt in the remainder of the runner has solidified. The inline riser also allows more time for entrained gases to escape from the melt into the sand surrounding the riser before the melt enters the mold cavity. Preferably, each gate has a centerline, and each runner-fomimg portion of the pattern has a runner-lightener. The runner-lightener extends into each riser-forming portion so as to produce an arcuate melt flow-front in the riser that is centered on the centerline of the gate as the melt advances through the riser toward the gate. To this end, the runner-lightener preferably extends into the riser-forming portion sufficiently above the gate's centerline as to allow the foam beneath the runner-lightener to slump, when engaged by the hot melt, yet still keep the melt flow-front centered on he gate's centerline.

A still further improvement is achieved when the gate-forming portion of the pattern forms a gate having a mouth that receives melt from the riser, and the pattern includes a moat that surrounds the mouth and forms a dam of sand around the mouth when the pattern is embedded in the sand. The sand dam serves to trap particulates (e.g. sand) that might be carried by a liquefied foam layer that precedes the melt during pouring, and thereby keeps the particulates and some polymer (e.g. styrene) out of the mold cavity.

As a result of the foregoing, hotter and cleaner melt enters the mold cavity through all of the gates substantially simultaneously with a consequent reduction in the number and size of folds and shuts, and reduced entrained particulates.

BRIEF DESCRIPTION OF THE DRAWINGS

The invention will be better understood when considered in the light of the following detailed description of a preferred embodiment thereof which is given hereafter in conjunction with the several drawings in which.

DESCRIPTION OF THE PREFERRED EMBODIMENT

Figure 1:
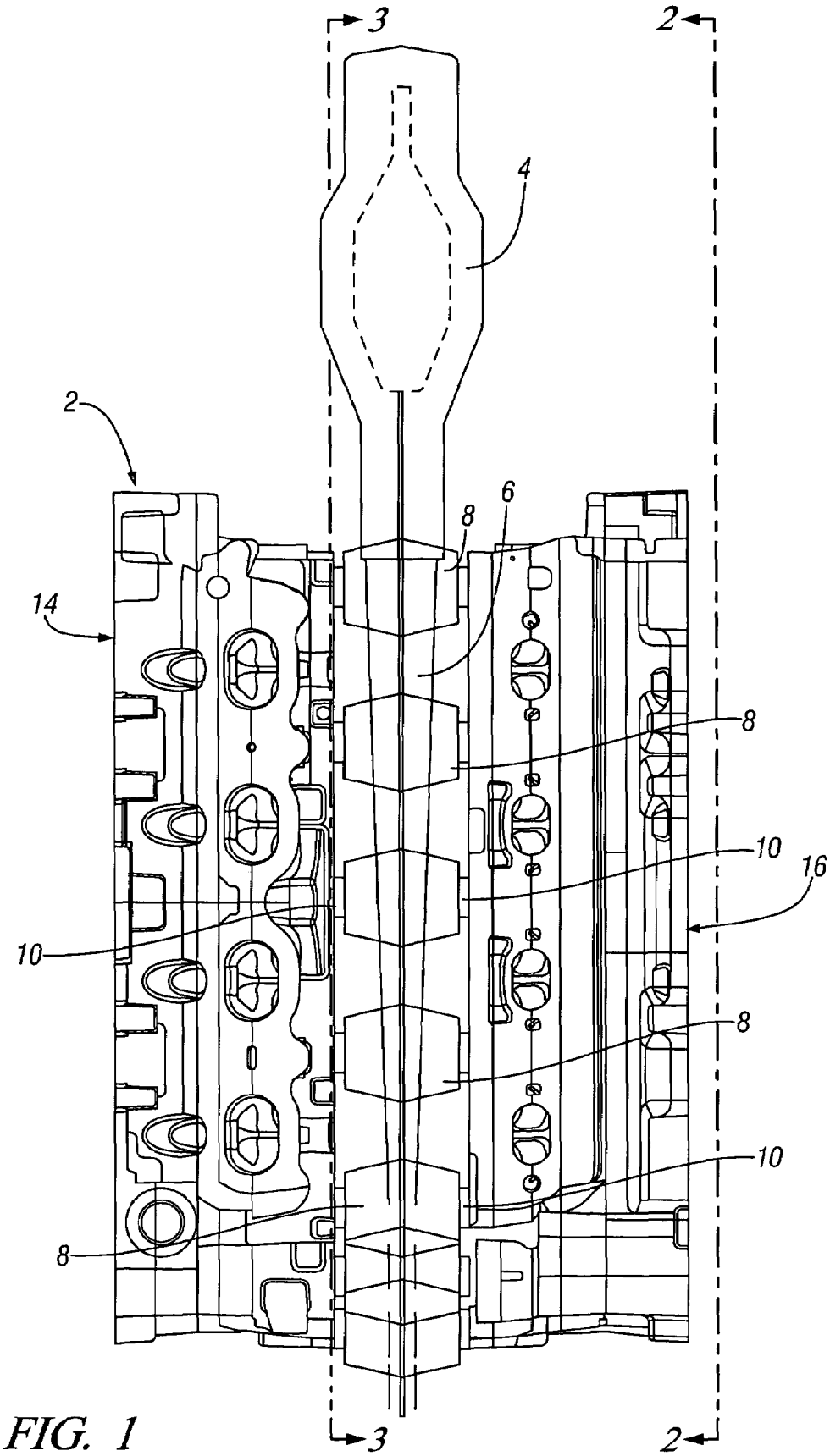
FIG. 1 is a side elevational view of a lost foam pattern according to the present invention.
Figure 2:
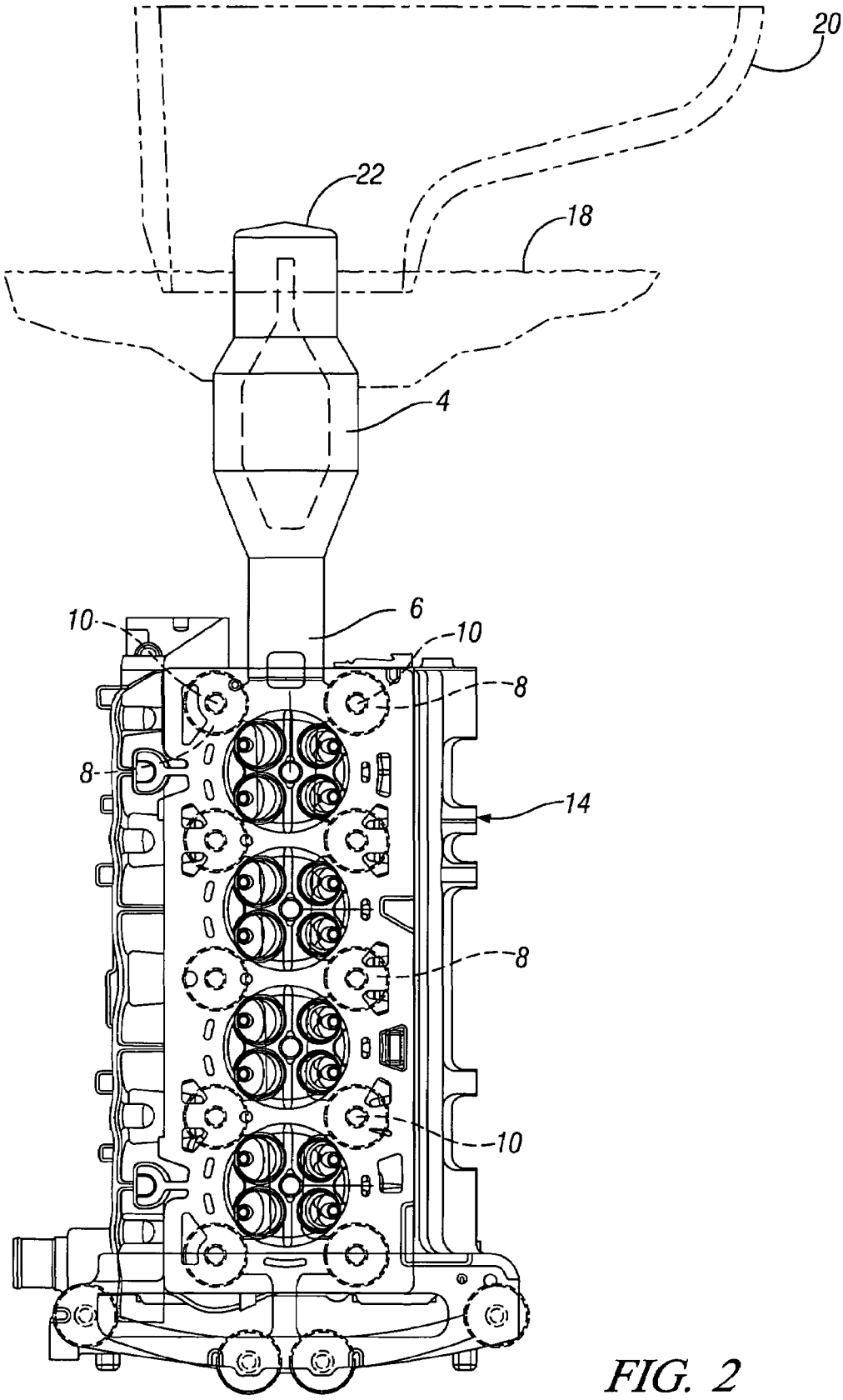
FIG. 2 is a front elevational view of the pattern of FIG. 1 taken in the direction 2—2 of FIG. 1.
Figure 3:
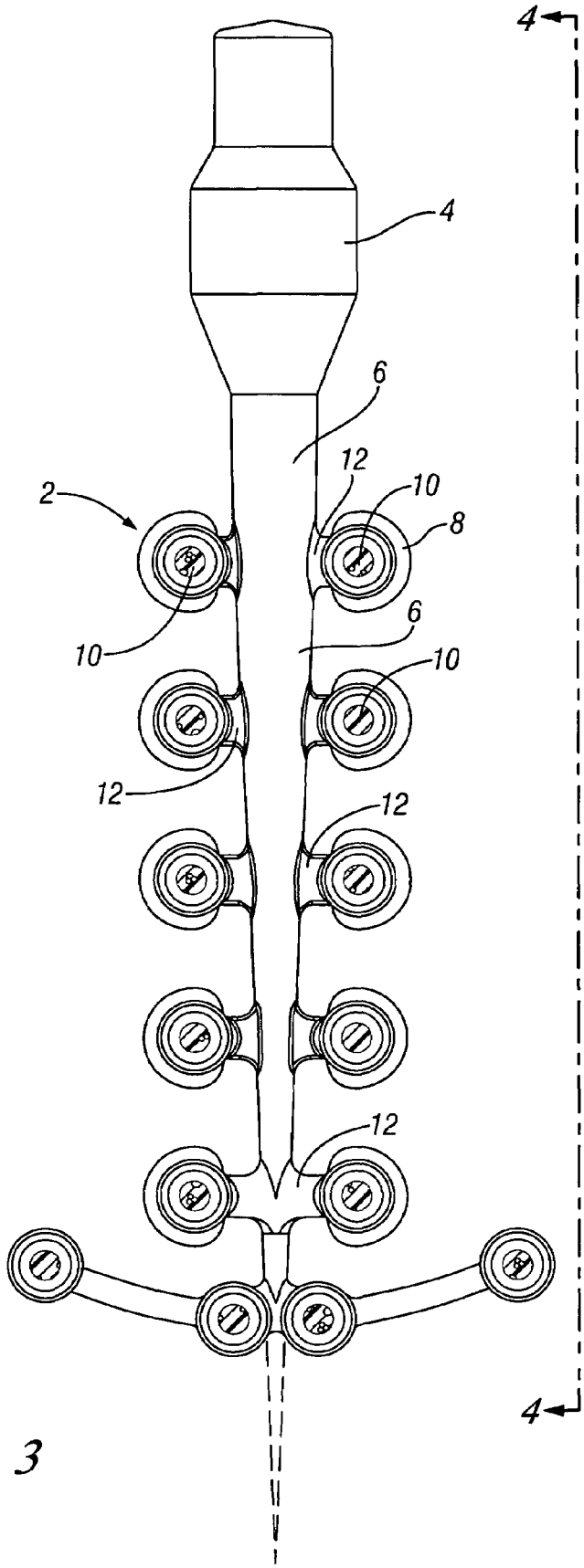
FIG. 3 is a sectioned view of the basin-, sprue-, runner- and gate-forming portions of the pattern of FIG. 1, taken in the direction 3—3 of FIG. 1 (sans the background casting-forming portion)

The several Figures show a fugitive, EPS lost foam pattern 2 comprising a pouring-basin-forming portion 4, a sprue-forming portion 6, a plurality of riser-forming portions 8, a plurality of gate-forming portions 10, a plurality of runner-forming portions 12 (see FIG. 3), and a pair of mold-cavity-forming portions 14 and 16 for forming the desired castings, here shown to be heads for an internal combustion engine. The pattern 2 (sans molding cavity forming portions 14 and 16) is molded in two parts, and glued together by means of a ribbon (i.e. about 2 mm wide) of glue applied along the outer periphery of the pattern where the pattern halves meet. The pattern 2 is embedded in a bed of compacted, unbonded sand having to a level 18 (see FIG. 2). A pouring cup 20 mates with the top 22 of the pouring-basin-forming portion 4, as shown, for directing melt into the pouring-basin-forming portion 4.

The sprue-forming portion 6 takes the form of a truncated, inverted cone with its upper and wider end 32 adjacent the plug 26, and its lower, narrower end 34 adjacent the bottom 36 of the pattern 2. The cone-shaped sprue-forming portion is defined by a wall 38 that tapers from the upper end to the lower end, which wall, if projected passed the bottom 36 of the pattern 2, would form the tip of the cone (not shown).

The shape of the cone is such that the included angle at this tip, if it existed, is between about 4 degrees and about eight degrees. Below about 4 degrees, melt turbulence at the lower end of the sprue is excessive, and above about 8 degrees, melt turbulence at the upper end of the sprue is excessive, both of which undesirably whip air and pyrolysis gases into the melt. Moreover, a conical sprue has less surface area from which heat can escape, and hence results in hotter melt being cast.

Figure 4:
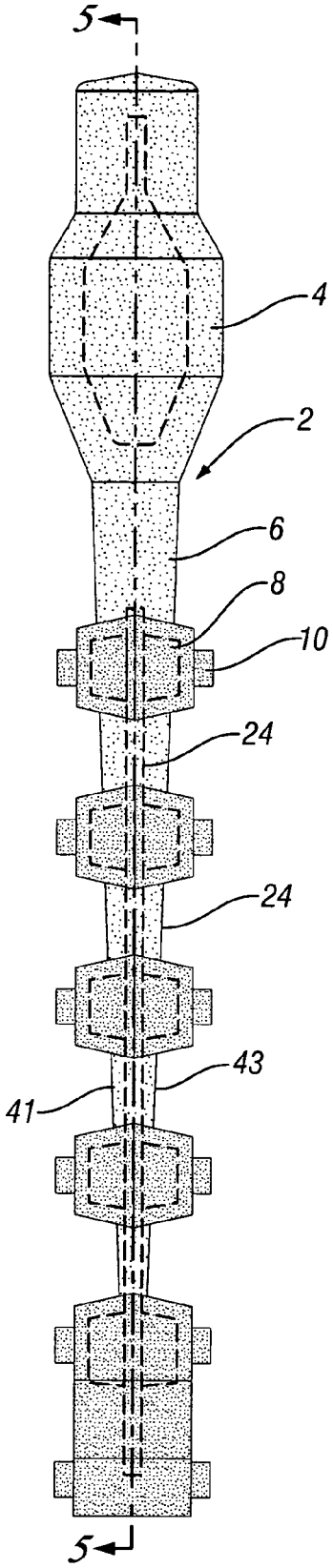
FIG. 4 is a side elevational view of the pattern of FIG. 3 taken in the direction 4—4 of FIG. 3.
Figure 5:
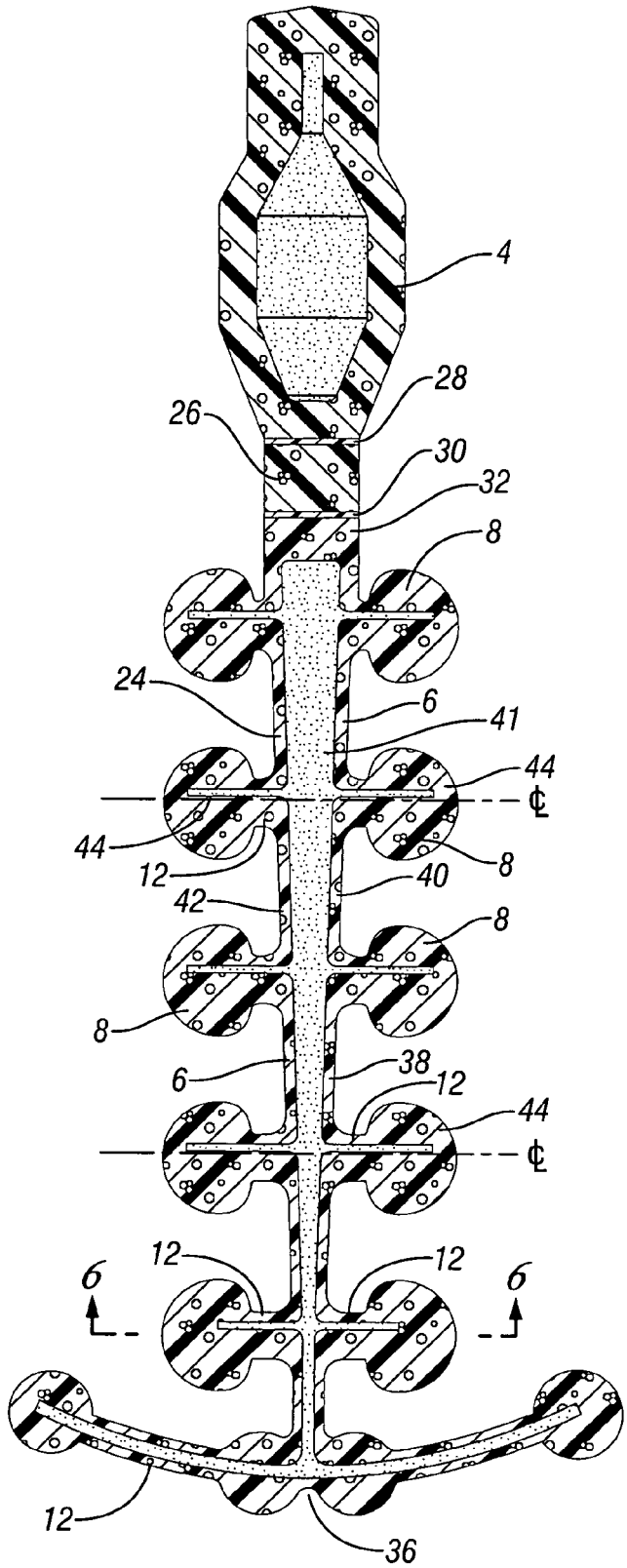
FIG. 5 is a sectioned view in the direction 5—5 of FIG. 4.

As best shown in FIGS. 4 and 5, the sprue-forming portion 6 has a tapering sprue-lightener 24 formed in the longitudinal center thereof. The sprue-lightener takes the form of a blade-lightener which resembles the sheath for the blade of a dagger/stiletto or 2-edge sword, in that it is significantly broader/wider than it is thick, and has a pair of opposed, edges 40, 42 that define a pair of opposed, generally flat (may be slightly arcuate), faces 41, 43. The sprue-lightener ranges in thickness from 1 mm to 4 mm. Below 1 mm thickness, there is a risk that the heated foam will swell and close off the lightener. Above 4 mm a large pocket of air is trapped in the lightener which causes a bubble to form in the melt. Preferably, The sprue-lightener fills most of the vertical cross section of the sprue-forming portion (i.e. when viewed in a plane through the lightener's face), and most preferably extends laterally from the glue line along one side of the sprue-forming portion to the glue line along the opposite side of the sprue-forming portion. Preferably, the opposed edges of the sprue-lightener will converge and intersect so as to define an included angle that is the same included angle as that of the tip of the conical sprue for quick, substantially non-turbulent, filling of the sprue-lightener and substantially simultaneous firing of the gates. Ideally, the sprue-lightener will be as thin as possible and as wide as possible, for optimal shaping of the melt front in the sprue.

The sprue-forming portion 6 is separated from the basin-forming portion 4 by a fugitive plug 26. The fugitive plug 26 is eventually destroyed by the heat of the melt, but in the meantime, serves to provide some residence time for melt in the basin by delaying outflow of melt from the basin. Different materials could be used to make the plug 24. Preferably, the plug 24 is made from the same polymeric foam that the rest of the pattern is made from, and provides about 2 secs. of residence time. Where additional residence time is desirable, the plug 24 may be provided with one or more fugitive glue joints 28, 30 at different locations transverse the plug 24. Different glues and different thicknesses thereof can be combined to fine tune the residence time. Glue joints about 0.25 mm thick and made from with ashless hot melt glue (e.g. GA 1525 available from Grow Group Inc.) each add about 2 secs. residence time. The residence time is provided to allow the melt in the basin to quiesce, degas and build-up a metallostatic head in the basin before it is released into the sprue. The head will be sufficient for the melt to quickly fill the sprue and force any gas therein into the surrounding sand without forming any bubbles in the melt, which could happen if the head of the melt were too low. To this end, for casting aluminum I/C engine heads, a head of melt in the basin greater than about 15 cms. above the top of the sprue is preferred.

Runner-forming portions 12 form runners in the sand which communicate the sprue, formed by the sprue-forming portion 6, with the gates formed by the gate-forming portions 10. The runner-forming portions 12 include inline riser-forming portions 8 which provide a plurality of riser chambers in the sand. Melt flows through the inline riser during pouring of the melt, and is stored as a liquid therein for outflow into the mold cavity to feed shrinkage in the casting after the melt in the remainder of the runner has solidified. The inline riser also allows more time for entrained gases to escape from the melt into the sand surrounding the riser before the melt enters the mold cavity. The runner-forming portions 12 include pencil-type runner-lighteners 44 extending from the blade lightener edges 40, 42 into the riser-forming portions 8 (see FIG. 6). The runner-lighteners 44 provide quick access by the melt to the riser-forming portions 8, and are located so as form an arcuate melt flow-front 46 (see FIG. 7A) in the riser 48 formed in the sand 50 by the riser-forming portion 8. The runner-lightener 44 is positioned in the riser-forming portion 8 such as to create melt flow front that is centered on the centerline of the gate toward which it advances. Preferably, the runner-lightener extends into the riser-forming portion 8 slightly above the centerline of the gate that it serves to allow the foam beneath the runner-lightener 44 to slump, when engaged by the hot melt, yet still keep the melt flow-front centered on the gate's centerline.

Figure 6:
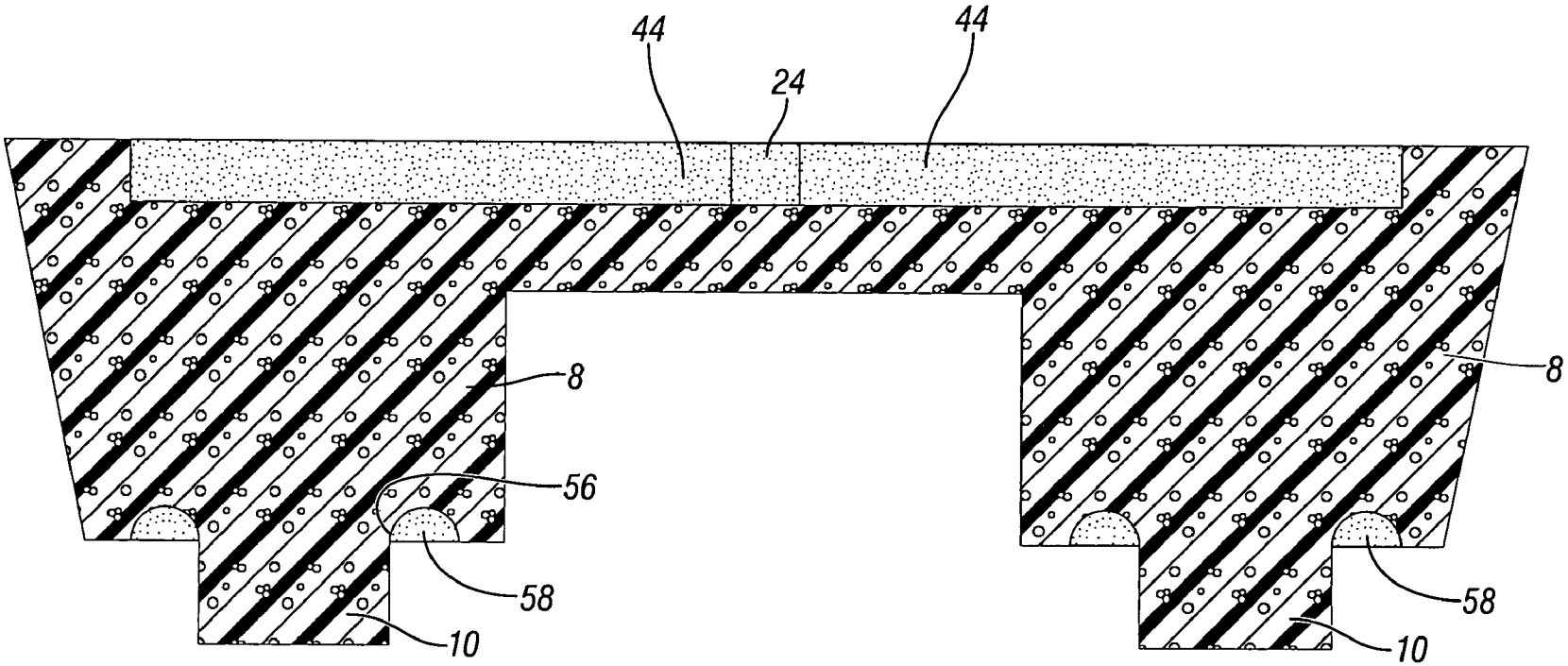
FIG. 6 is a sectioned view in the direction 6—6 of FIG. 5.
Figure 7A:
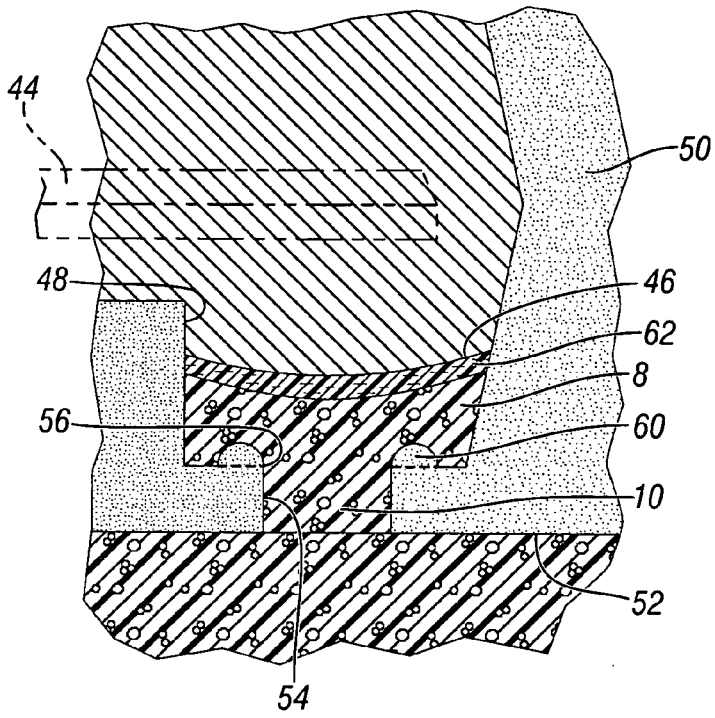
FIG. 7A depicts the melt flow front in the riser before the melt enters the gate.
Figure 7B:
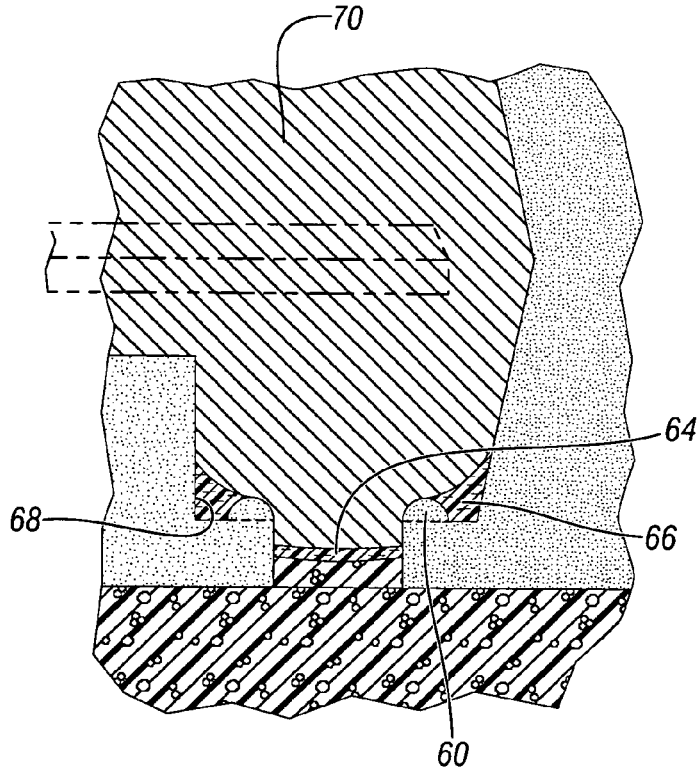
FIG. 7B depicts the melt flow front in the gate.

As best shown in FIGS. 6 and 7, the pattern 4 further comprises gate-forming portions 10 for forming gates 54 in the sand 50 through which melt is admitted to the mold cavity 52. The gates 54 each have a mouth 56 receiving melt from the riser upstream the gate. A moat 58 surrounds the gate-forming portion 10 for forming a dam 60 of sand 50 around the mouth 56 of the gate 54. The dam 60 serves to trap particulates carried by liquefied foam that is pushed ahead of the melt flow front 46, as will be described in more detail hereinafter.

In operation, melt (e.g. molten aluminum) is supplied to the pouring cup 20 from which it flows into the pouring basin formed by the pouring-basin-forming portion 4 of an EPS pattern 2. A fugitive plug 26, (with or without a fugitive glue joint 28, 30) briefly (e.g. ca. 2–4 seconds) prevents the melt in the pouring basin from exiting the basin, thereby allowing it quiese, degas and build-up in the basin to a prescribed level. The heat from the melt eventually destroys the plug 26 (and glue joint 28, 30, if present) which allows the melt built-up in the basin to forcefully rush into the sprue-lightener 24 in the sprue-forming portion 6, and thence immediately into the runner-lighteners 44 from the edges 40, 42 of the sprue-lightener. The runner-lighteners 44 extend into the riser—forming portions 8 of the pattern 4. The melt immediately begins to fill the riser and forms an arcuate flowfront 46 that advances toward the gate-forming portion 10 (see FIG. 7A) along the centerline of the gate. As the melt flowfront 46 advances on the gate, it melts the foam in front of it, and forms layer of liquid styrene 62 in front of it that is pushed ahead of the metal flowfront 46 (see FIG. 7A). When the styrene layer 62 reaches the mouth 56 of the gate 54 it engages the sand dam 60 and is separated into a center portion 64 and a perimeter portion 66. The center portion 64 enters the gate while the perimeter portion 66, and any particulates entrained therein, become trapped in an annular region 68 behind the dam 60. Melt enters the gate from the center of the riser where it is hottest, which serves to reduce the formation of folds. Moreover, the melt in the center of the risers remains molten even after the melt in the remainder of the runner has solidified, and continues to feed melt to the mold cavity to make up for shrinkage of the casting.

While the invention has been described in terms of a specific embodiment thereof it is not intended to be limited thereto, but rather only to the extent set forth hereafter in the claims which follow.

I claim:

1. In a pattern for the lost foam casting of a metal melt in a bed of unbonded sand comprising a fugitive polymeric foam having discrete portions configured to form: (1) a pouring basin that receives melt from an external supply thereof and dispenses it through an outlet from the basin; (2) a vertical sprue underlying said basin and formed by a sprue-forming portion, said sprue-forming portion having a sprue-lightener extending the length of the sprue-forming portion; (3) at least one mold-cavity laterally adjacent said sprue, for forming a casting; (4) a plurality of runners vertically arranged along and between said sprue and said cavity for delivering said melt to said cavity; and (5) a plurality of gates each communicating a said runner with said cavity for admitting melt into said cavity; the improvement comprising: (a) said sprue-forming portion comprising an inverted cone having a wall that tapers from an upper end adjacent said basin to a lower end that defines a first included angle between about 4° and about 8° to minimize turbulence of said melt at said lower and upper ends, respectively, during pouring of said melt; (b) said sprue-lightener comprising a tapering blade-lightener configured to substantially simultaneously initiate flow of said melt through said gates into said cavity, said blade-lightener having a pair of opposing edges that lie inboard said wall and define a pair of opposing faces that are each significantly wider than said blade-lightener is thick, and fill the majority of the vertical cross section of said sprue when viewed in a plane of a said face; and (c) a plurality of runner-lighteners each extending into a said runner from a said edge for rapidly advancing said melt into said runners.

2. A lost foam pattern according to claim 1 including a fugitive plug between said inlet and said outlet for delaying the outflow of said melt from said basin into said sprue until a prescribed amount of melt has accumulated in said basin.

3. A lost foam pattern according to claim 1 wherein said edges of the blade-lightener converge near the bottom of the sprue to define a second included angle equal to about the first included angle.

4. A lost foam pattern according to claim 2 wherein each said runner includes an inline chamber formed by a riser-forming portion and defining a riser through which melt flows to supply said gate during pouring of the melt, and in which melt is stored for outflow into said cavity after the melt in the remainder of the runner has solidified and as the melt in said cavity solidifies and shrinks.

5. A lost foam pattern according to claim 4 wherein said gate has a centerline, and a runner-lightener extends into each riser-forming portion so as to produce an arcuate melt flow-front that is centered on said centerline as the melt advances through said riser toward said gate.

6. A lost foam pattern according to claim 5 wherein said runner-lightener extends into said riser-forming portion sufficiently above said centerline as to allow the foam beneath said runner-lightener to slump when engaged by said melt yet still keep said flow-front centered on said centerline.

7. A lost foam pattern according to claim 2 including at least one fugitive glue-joint transverse said fugitive plug for further delaying the introduction of said melt into said sprue.

8. A lost foam pattern according to claim 5 wherein each gate-forming portion forms a gate having a mouth receiving melt from said riser, and a moat surrounding said gate-forming portion for forming a dam of sand around said mouth when said pattern is embedded in sand to trap particulates carried by liquefied said foam that is pushed ahead of said flow-front.

* * * * *